US009129576B2

(12) United States Patent
Chen

(10) Patent No.: US 9,129,576 B2
(45) Date of Patent: Sep. 8, 2015

(54) GATE DRIVING WAVEFORM CONTROL

(75) Inventor: Ping-Po Chen, Tainan (TW)

(73) Assignee: Himax Technologies Limited, Tainan County (TW)

( * ) Notice: Subject to any disclaimer, the term of this patent is extended or adjusted under 35 U.S.C. 154(b) by 2017 days.

(21) Appl. No.: 12/116,043

(22) Filed: May 6, 2008

(65) Prior Publication Data

US 2009/0278782 A1 Nov. 12, 2009

(51) Int. Cl.
*G09G 3/36* (2006.01)

(52) U.S. Cl.
CPC ..... *G09G 3/3677* (2013.01); *G09G 2300/0426* (2013.01); *G09G 2310/0281* (2013.01); *G09G 2310/0286* (2013.01); *G09G 2310/08* (2013.01)

(58) Field of Classification Search
USPC ..... 345/100
See application file for complete search history.

(56) References Cited

U.S. PATENT DOCUMENTS

| | | | | |
|---|---|---|---|---|
| 5,850,216 | A * | 12/1998 | Kwon | 345/204 |
| 2004/0080480 | A1 * | 4/2004 | Zhang et al. | 345/90 |
| 2004/0183792 | A1 * | 9/2004 | Takada et al. | 345/204 |
| 2005/0156861 | A1 * | 7/2005 | Song | 345/100 |
| 2006/0279511 | A1 * | 12/2006 | Uh et al. | 345/100 |
| 2008/0055282 | A1 * | 3/2008 | Lee | 345/204 |

* cited by examiner

*Primary Examiner* — Amare Mengistu
*Assistant Examiner* — Shawna Stepp Jones
(74) *Attorney, Agent, or Firm* — Donald E. Stout; Stout, Uxa & Buyan, LLP

(57) ABSTRACT

A gate driver and associated method for a double gate liquid crystal display (LCD) is disclosed. A gate driving signal generating circuit, such as coupled shift registers, generates the gate driving signals in response to horizontal synchronization signal. In one embodiment, a phase control circuit, such as logic AND gates, is coupled to receive the outputs of the shift registers for determining phase relationship between the outputs of the shift registers and the horizontal synchronization signal.

25 Claims, 10 Drawing Sheets

GATE DRIVING WAVEFORM CONTROL

BACKGROUND OF THE INVENTION

1. Field of the Invention

The present invention generally relates to liquid crystal display (LCD), and more particularly to gate driving waveform control for double gate LCD.

2. Description of the Prior Art

A liquid crystal display (LCD) typically includes rows and columns of picture elements (or pixels) arranged in matrix form. Each pixel includes a thin film transistor (TFT) and a pixel electrode formed on a substrate (or panel). The gates of the TFTs in the same row are connected together through a gate line, and controlled by a gate driver (or scan driver). The sources of the TFTs in the same column are connected together through a source line, and controlled by a source driver (or data driver). A common electrode is formed on another substrate (or panel). A liquid crystal (LC) layer is sealed between the pixel electrode substrate and the common electrode substrate, and the voltage difference between the pixel electrode and the common electrode determines the display of the pixels.

The gate driver and the source driver are formed with a number of driving integrated circuit (IC) chips, respectively. As the source driving IC chip typically has cost higher than the gate driving IC chip, it is thus advantageous to reduce the number of the source driving IC chips in the LCD, even to increase the number of the gate driving IC chips. Accordingly, some double (or dual) gate LCD structures are disclosed, in which the number of the source lines (and the source driving IC chips) is reduced in half, while the number of the gate lines (and the gate driving IC chips) is doubled. As a whole the double gate LCD generally costs less than the conventional LCD. In the operation of the double gate LCD, the TFTs in the same line are turn on in turn, rather than at the same time as in the conventional LCD, during a cycle of horizontal scan (usually abbreviated as 1H).

As a result, nevertheless, the timing controller (or T-con) has to provide the gate driver clock signals that have the frequency two times the clock frequency of a conventional non-double gate LCD. The high frequency disadvantageously associates with complex circuitry, large circuit area and high cost. For the foregoing reason, a need has arisen to propose a novel gate driving waveform control for the double gate LCD which benefits with the double gate LCD without increasing complexity, area and cost in circuitry.

SUMMARY OF THE INVENTION

In view of the foregoing, it is an object of the present invention to propose a novel gate driving waveform control for the double gate LCD to benefit with the double gate LCD without increasing complexity, area and cost in circuitry.

According to the embodiments, the present invention provides a gate driver and associated method for a double gate liquid crystal display (LCD). A gate driving signal generating circuit, such as coupled shift registers, generates the gate driving signals in response to horizontal synchronization signal. In one embodiment, a phase control circuit, such as logic AND gates, is coupled to receive the outputs of the shift registers for determining phase relationship between the outputs of the shift registers and the horizontal synchronization signal. Furthermore, level shifters are utilized to adjust voltage level of the gate driving signals, and output buffers are used to provide buffer to the voltage-level adjusted gate driving signals.

DETAILED DESCRIPTION OF THE INVENTION

Figure 1A:
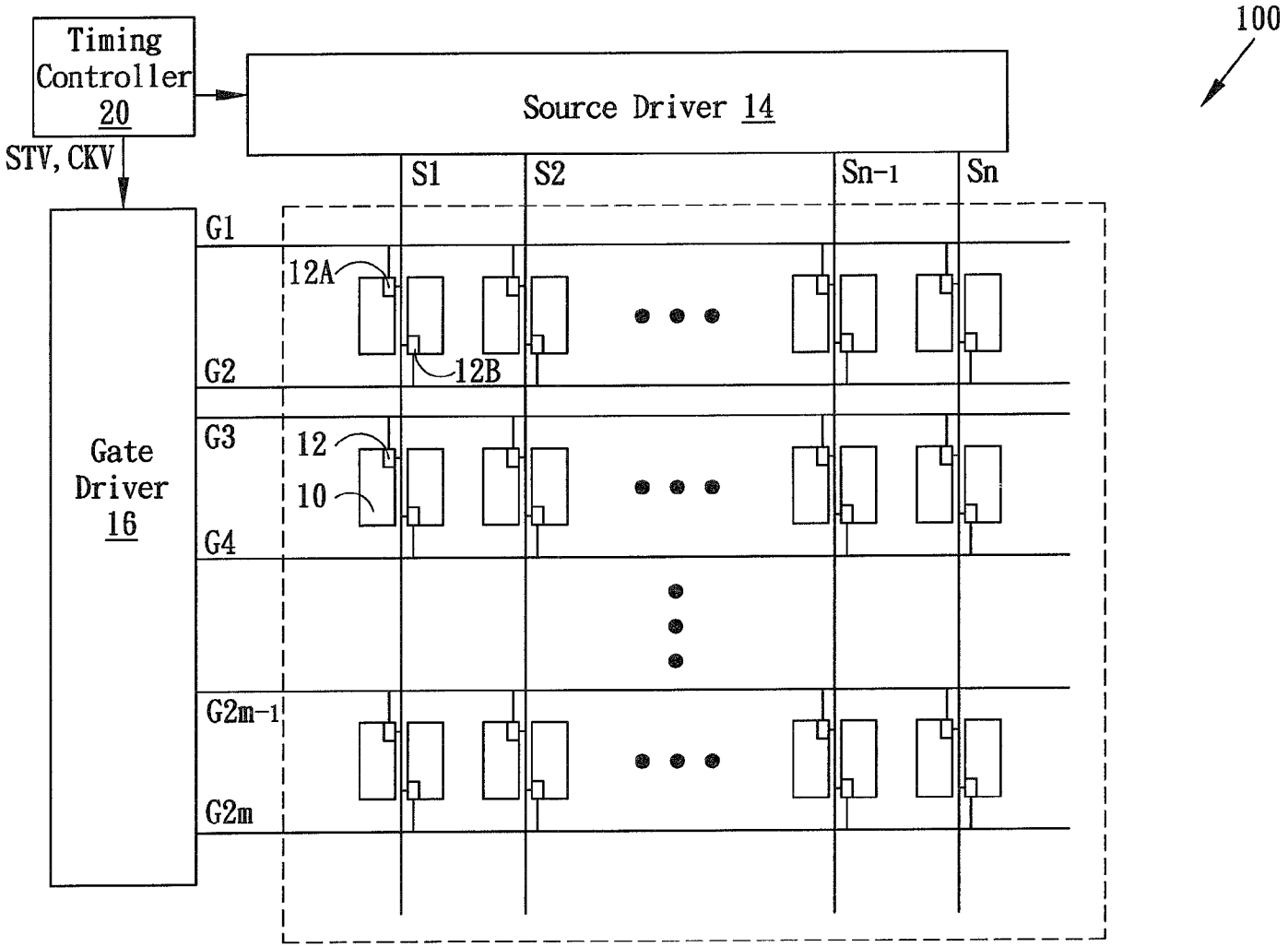
FIG. 1A illustrates a double gate liquid crystal display (LCD) with one-sided gate driver.

FIG. 1A illustrates a double gate liquid crystal display (LCD) 100, which includes rows and columns of pixel electrodes 10 arranged in matrix form. A switching element 12, such as a thin film transistor (TFT) corresponds to each pixel electrode 10 in a picture element (or pixel). In a row, neighboring TFTs (for example, 12A and 12B) share a source line (for example, S1), which is driven by a source driver 14; and the sources of the TFTs (12A and 12B) in the neighboring columns are connected together through the shared source line (S1). In the row, a portion of the TFTs 12 (for example, the odd TFTs) are connected together through a gate line (for example, G1) driven by a gate driver 16, and other portion of the TFTs 12 (for example, the even TFTs) are connected together through another gate line (for example, G2) driven by the gate driver 16. These two gate lines form the pair of gate lines for the corresponding row of pixels. In the embodiment, the double gate LCD 100 has a one-sided gate driver 16, which is located on one edge of the pixels. A timing controller 20 (or T-con) controllably synchronizes the operation of the gate driver 16 and the source driver 14.

Figure 1B:
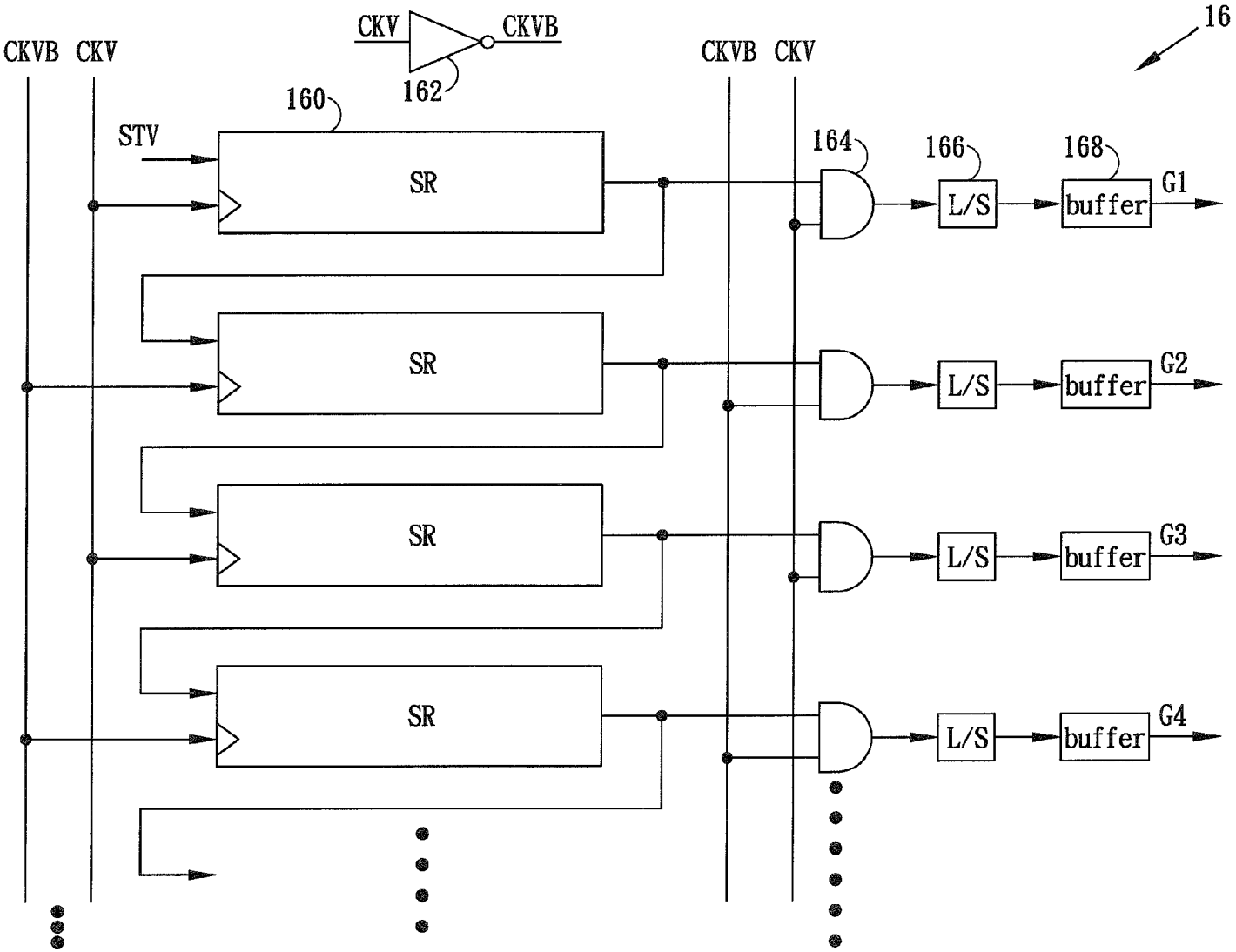
FIG. 1B illustrates a detailed circuit of the gate driver in FIG. 1A according to the first embodiment of the present invention.
Figure 1C:
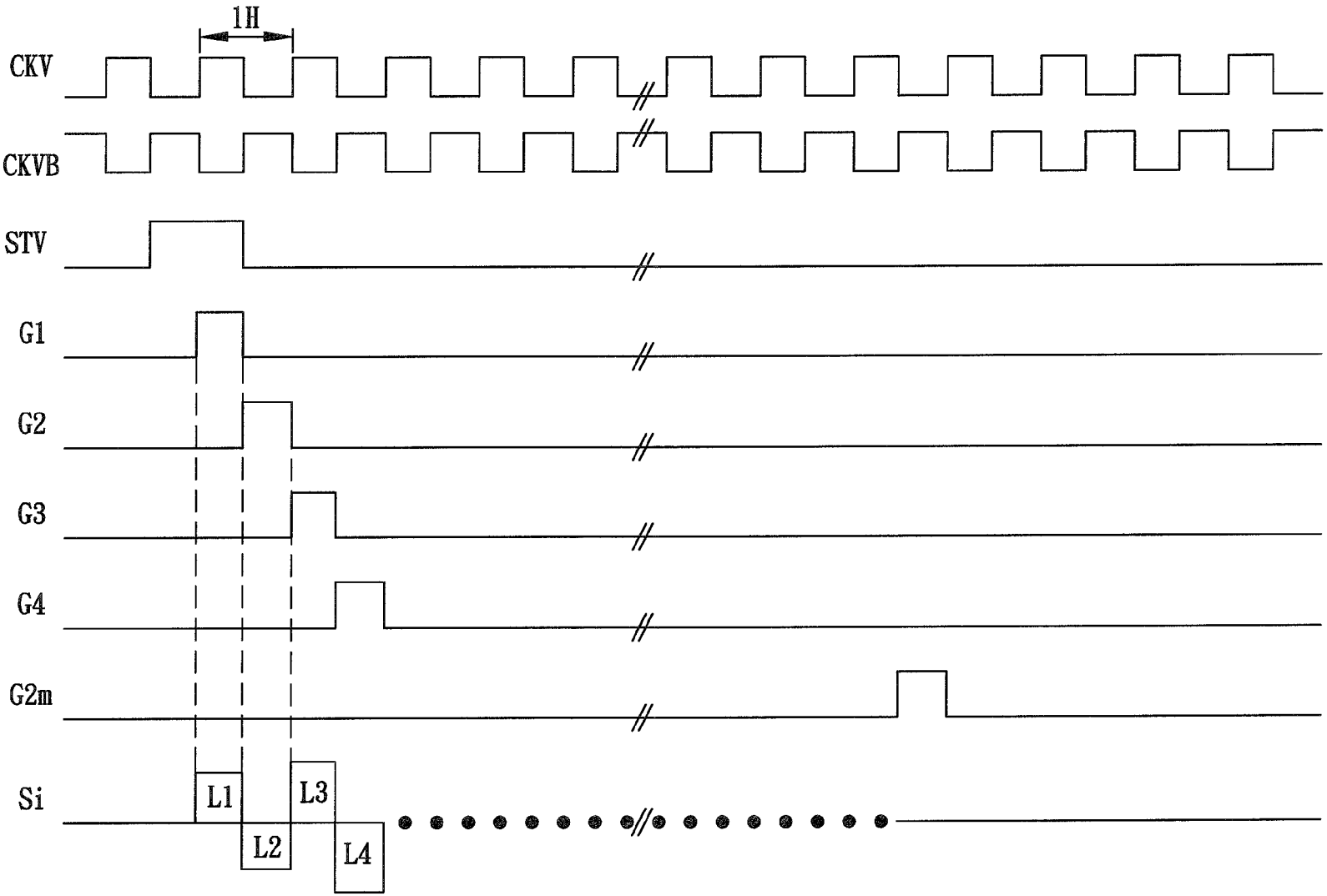
FIG. 1C shows a timing diagram illustrating the resultant gate driving waveforms associated with the gate driver of FIG. 1B.

FIG. 1B illustrates a detailed circuit of the gate driver 16 in FIG. 1A according to the first embodiment of the present invention, and FIG. 1C shows a timing diagram illustrating the resultant gate driving waveforms associated with the gate driver 16 of FIG. 1B.

In the embodiment, the gate driver 16 primarily includes a number of shift registers (SR) 160. Each shift register 160 has an input terminal for receiving an input signal, a clock terminal for receiving a clock signal, and an output terminal for producing an output signal. The shift register 160 is utilized to transfer or shift the input signal to the output terminal in response to each clock signal. The shift register 160 may be implemented, for example, by a D-type flip-flop. According to the embodiment, the first (topmost) shift register 160 receives the vertical synchronization signal STV, while the second (and following) shift register 160 is coupled to receive the output signal of a previous shift register 160. The odd-number shift registers 160 operate under the direct control of horizontal synchronization signal CKV (provided by the timing controller 20 (FIG. 1A)); and the even-number shift registers 160 operate under the control of inverted horizontal synchronization signal CKVB, which is generated, for example, by an inverter 162. The inverter 162 may be located in the gate driver 16. In the embodiment, the duty cycle of the horizontal synchronization signal CKV is preferably, but not limited to, about 50%. The output signals of the shift registers 160 are associatively coupled to logic circuits 164 respectively. In the embodiment, each logic circuit 164 includes a logic AND gate with one input terminal receiving the associated output of the shift register 162, and another input terminal receiving the horizontal synchronization signal CKV or the inverted horizontal synchronization signal CKVB. Specifically, the odd-number AND gates 164 receive the horizontal synchronization signal CKV, while the even-number AND gates 164 receive the inverted horizontal synchronization signal CKVB. The AND gate 164 functions, under control of the signal CKV or CKVB, as a phase control circuit that determines the phase relationship between the resultant gate driving waveform G1-G4 and the horizontal synchronization signal CKV. For example, the first (topmost) or odd-number AND gate 164, via a level shifter (L/S) 166 and an output buffer 168 (which will be described in details later), outputs the first gate driving signal G1 which is asserted active in the first half cycle of the horizontal scan as shown in FIG. 1C; while the second or even-number AND gate 164, via the level shifter (L/S) 166 and the output buffer 168, outputs the second gate driving signal G2 which is asserted active in the second half cycle of the horizontal scan. Accordingly, the resultant gate driving signals G1-G2*m* have waveforms that are non-overlapping each other. Further, valid data S1 are provided by the source driver 14 (FIG. 1A) within the asserted active period of associated gate driving signals. For example, the first valid datum L1 is provided through the source line S1 by the source driver 14 when the first gate driving signal G1 is active, and the second valid datum L2 is provided through the source line S1 by the source driver 14 when the second gate driving signal G2 is active. Accordingly, the gate driving signals G1-G2*m* are generated in response to the original horizontal synchronization signal CKV, instead of double-frequency control signals generated by a timing controller in a conventional double gate LCD. Therefore, the double gate LCD according to the embodiment could benefit with the double gate LCD without increasing frequency in signal, or complexity, area and cost in circuitry.

Still referring to FIG. 1B, the gate driver 16 usually further includes a number of level shifter (L/S) 166, which are associatively coupled to the outputs of the logic circuits 164 respectively. The level shifter 166 is utilized to adjust the voltage level from a low-voltage level, such as 3 v/0 v or 5 v/0 v to a high-voltage level, such as 20 v/−5 v, such that the adjusted level could be conformed to that of the TFTs 12 (FIG. 1A). Moreover, the gate driver 16 usually further includes a number of (digital) output buffers 168, which are associatively coupled to the output of the level shifter 166 respectively. The output buffer 168 is utilized to increase the capability for driving the pixels of the LCD. The output buffer 168 may be implemented, for example, by cascading even number of digital inverters.

Figure 1D:
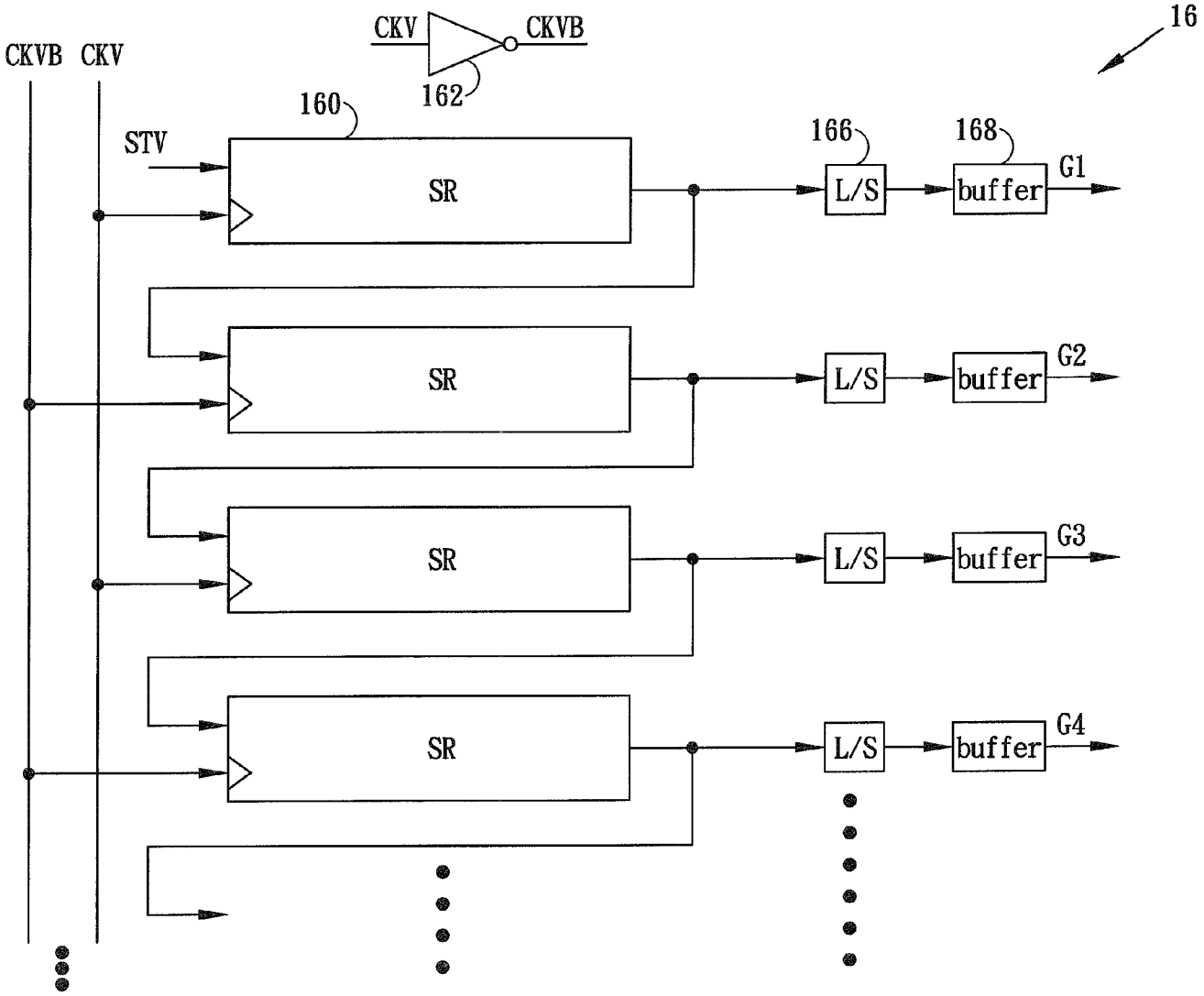
FIG. 1D illustrates a detailed circuit of the gate driver in FIG. 1A according to the second embodiment of the present invention.
Figure 1E:
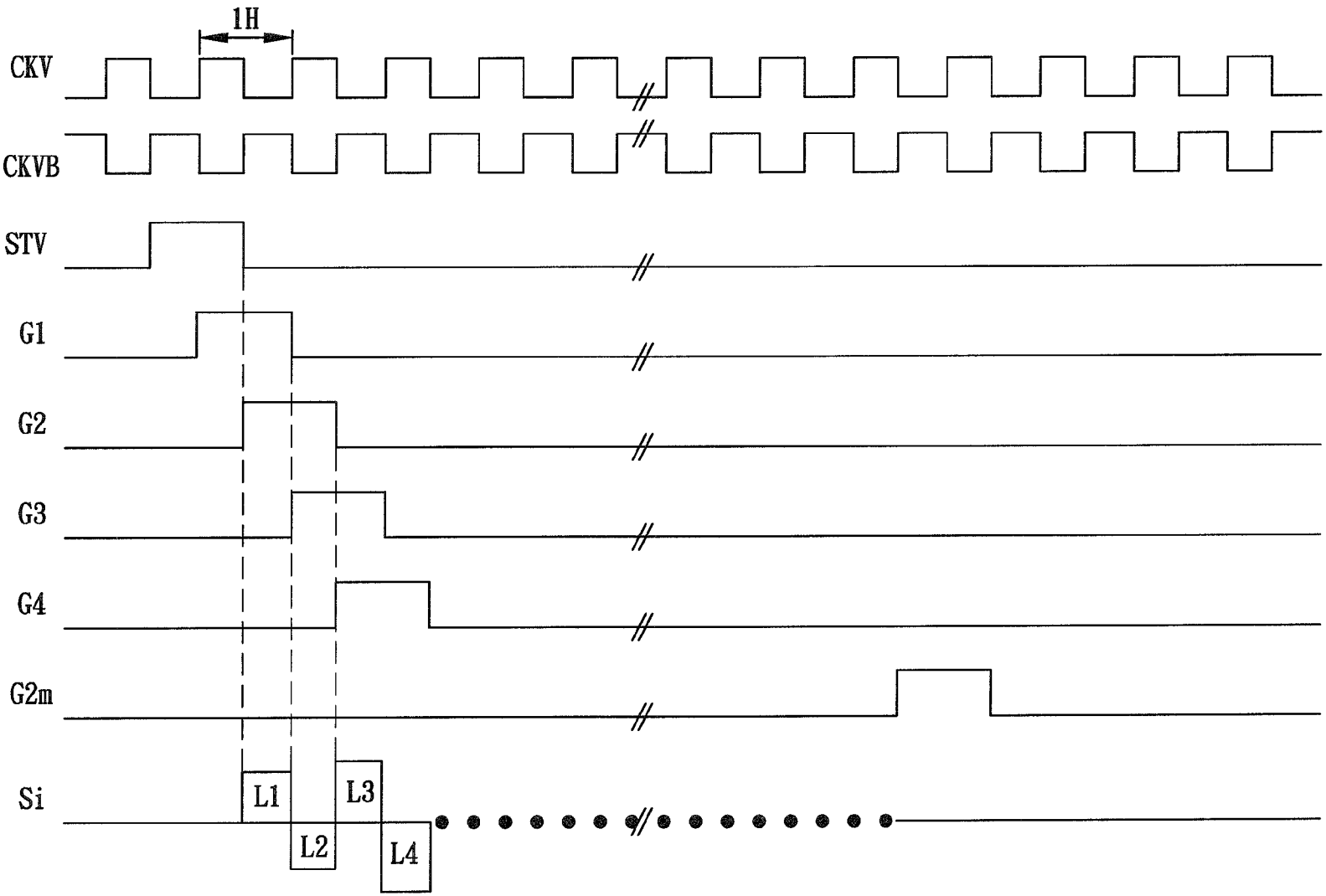
FIG. 1E shows a timing diagram illustrating the resultant gate driving waveforms associated with the gate driver of FIG. 1D.

FIG. 1D illustrates a detailed circuit of the gate driver 16 in FIG. 1A according to the second embodiment of the present invention, and FIG. 1E shows a timing diagram illustrating the resultant gate driving waveforms associated with the gate driver 16 of FIG. 1D.

In the embodiment, the gate driver 16 has a structure similar to that in FIG. 1B, except that no logic circuits (for example, the AND gates 164 in FIG. 1B) are used. The comprising elements, such as the shift registers 160, the level shifters 166 and the output buffers 168 are coupled and operated in the same manner as those in FIG. 1B, except that the outputs of the shift registers 160 are directly coupled to the level shifters 166. Therefore, corresponding discussion is omitted here for brevity. As the logic circuits 164 (FIG. 1B) are not used in this embodiment to control the phase relationship between the resultant gate driving waveform G1-G4 and the horizontal synchronization signal CKV, the resultant gate driving signals G1-G2*m* accordingly have waveforms that are overlapping each other as shown in FIG. 1E. For example, the first (topmost) or odd-number shift register 160, via the level shifter (L/S) 166 and the output buffer 168, outputs the first gate driving signal G1 which is asserted active beginning at the activation of the horizontal scan, and which extends a duration of a full horizontal scan cycle; while the second or even-number shift register 160, via the level shifter (L/S) 166 and the output buffer 168, outputs the second gate driving signal G2 which is asserted active beginning at the middle of the horizontal scan, and which extends a duration of a full horizontal scan cycle. Further, valid data S1 are provided by the source driver 14 (FIG. 1A) within the second half of the asserted active period of associated gate driving signals. For example, the first valid datum L1 is provided through the source line S1 by the source driver 14 within the second half of the active first gate driving signal G1, and the second valid datum L2 is provided through the source line S1 by the source driver 14 within the second half of the active second gate driving signal G2. As a result similar to the first embodiment, the gate driving signals G1-G2*m* are generated in response to the original horizontal synchronization signal CKV, instead of double-frequency control signals generated by a timing controller in a conventional double gate LCD. Therefore, the double gate LCD according to the embodiment could benefit with the double gate LCD without increasing frequency in signal, or complexity, area and cost in circuitry.

Figure 2A:
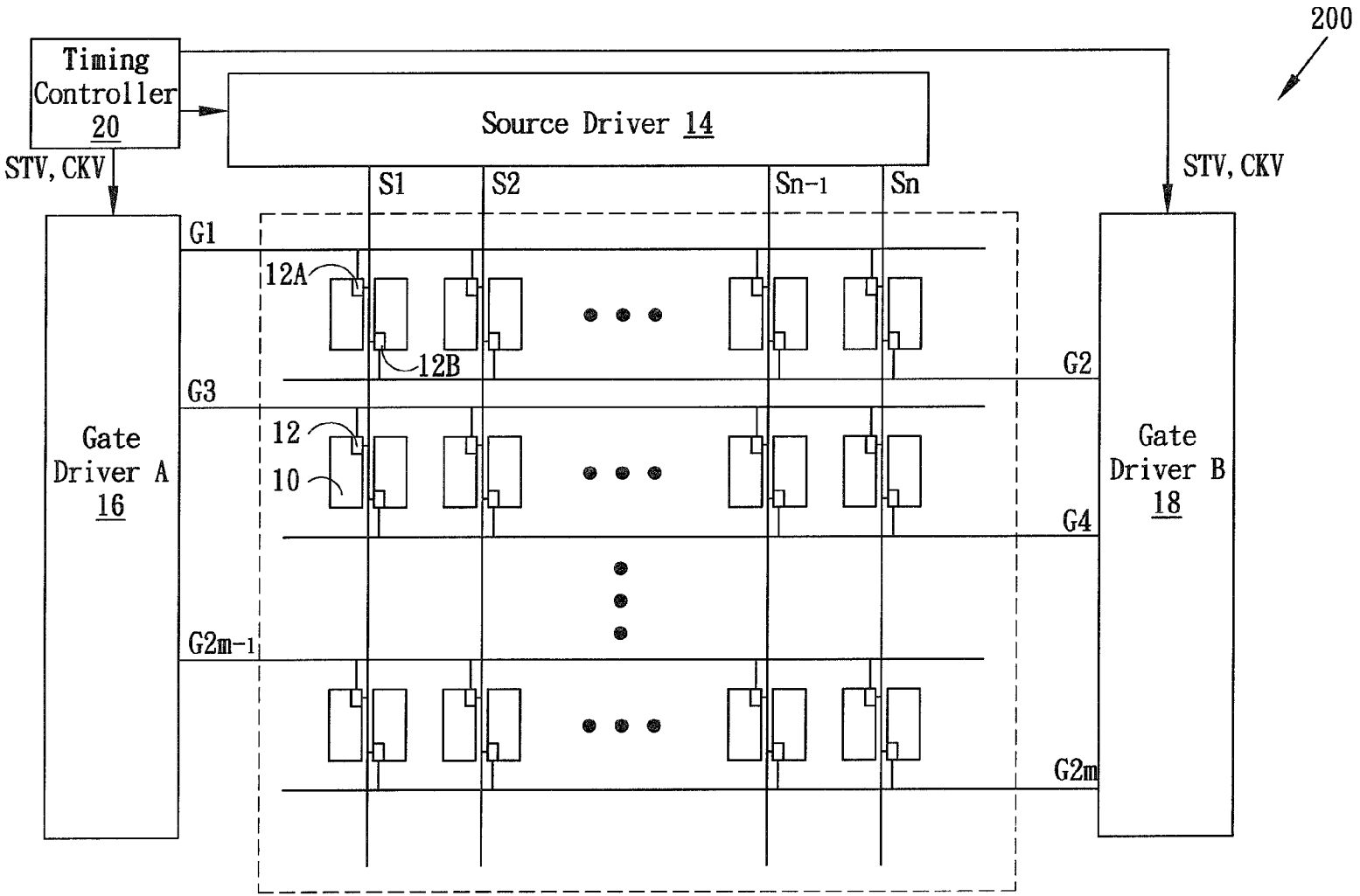
FIG. 2A illustrates a double gate LCD with two-sided gate drivers.

FIG. 2A illustrates a double gate LCD 200, which is similar to the double gate LCD 100 in FIG. 1A, except that the double gate LCD 200 has two-sided gate driver A 16 that is located on one edge of the pixels, and gate driver B 18 that is located on another edge of the pixels. Specifically, the gate driver A 16 provides the odd-number gate driving signals G1, G3 etc., and the gate driver B 18 provides the even-number gate driving signals G2, G4 etc.

Figure 2B:
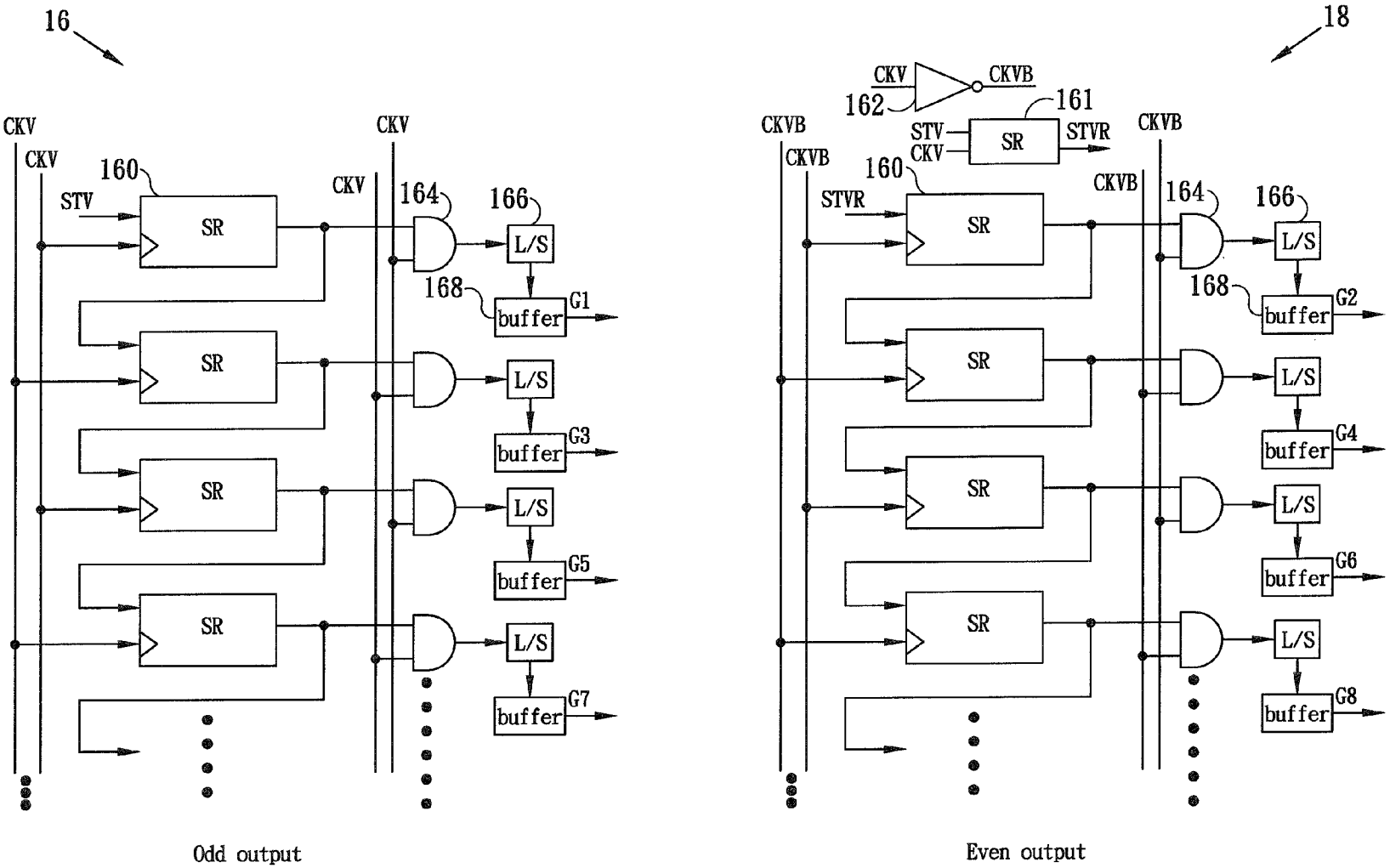
FIG. 2B illustrates a detailed circuit of the gate drivers in FIG. 2A according to the third embodiment of the present invention.
Figure 2C:
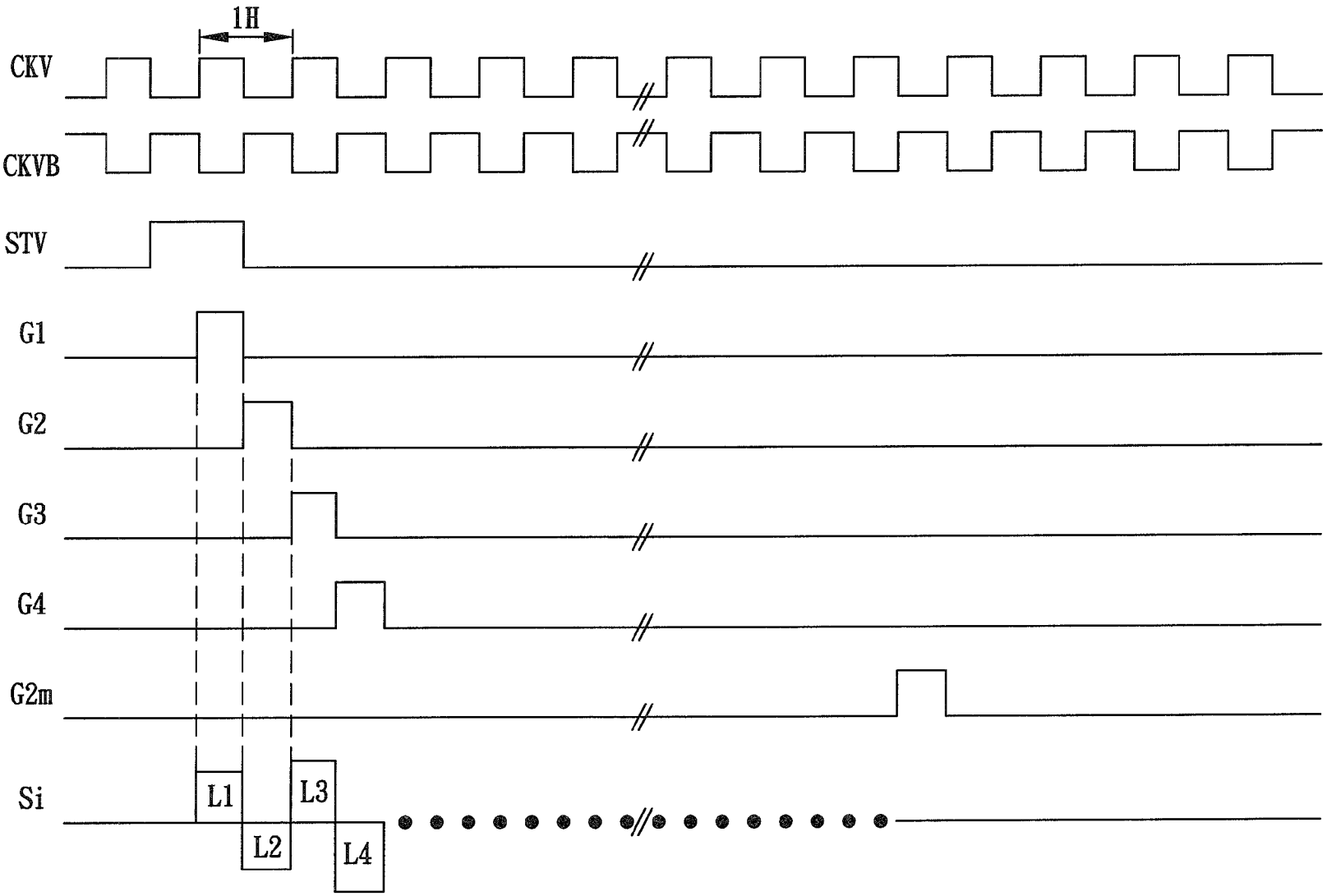
FIG. 2C shows a timing diagram illustrating the resultant gate driving waveforms associated with the gate drivers of FIG. 2B.

FIG. 2B illustrates detailed circuits of the gate driver A 16 and the gate driver B 18 in FIG. 2A according to the third embodiment of the present invention, and FIG. 2C shows a timing diagram illustrating the resultant gate driving waveforms associated with the gate drivers 16/18 of FIG. 2B.

In the embodiment, the gate driver A 16 has a structure similar to that in FIG. 1B, except that all shift registers 160 operate under the direct control of the horizontal synchronization signal CKV, and all the logic circuits (such as logic AND gates) 164 receive the horizontal synchronization signal CKV. Accordingly, the gate driver A 16 generates odd-number gate driving signals G1, G3 etc. which have the same waveforms as those in FIG. 1C, and are reproduced in FIG. 2C. With respect to the other gate driver B 18, it has a structure similar to the gate driver A 16 (FIG. 2B), except that all shift registers 160 operate under the direct control of the inverted horizontal synchronization signal CKVB, and all the logic circuits (such as logic AND gates) 164 receive the inverted horizontal synchronization signal CKVB. Further, the first (topmost) shift register 160 receives a shifted vertical synchronization signal STVR, which is generated, for example, by an additional shift register 161 that transfers or shifts the vertical synchronization signal STV under control of the horizontal synchronization signal CKV. Accordingly, the gate driver B 18 generate even-number gate driving signals G2, G4 etc. which have the same waveforms as those in FIG. 1C, and are also reproduced in FIG. 2C.

Figure 2D:
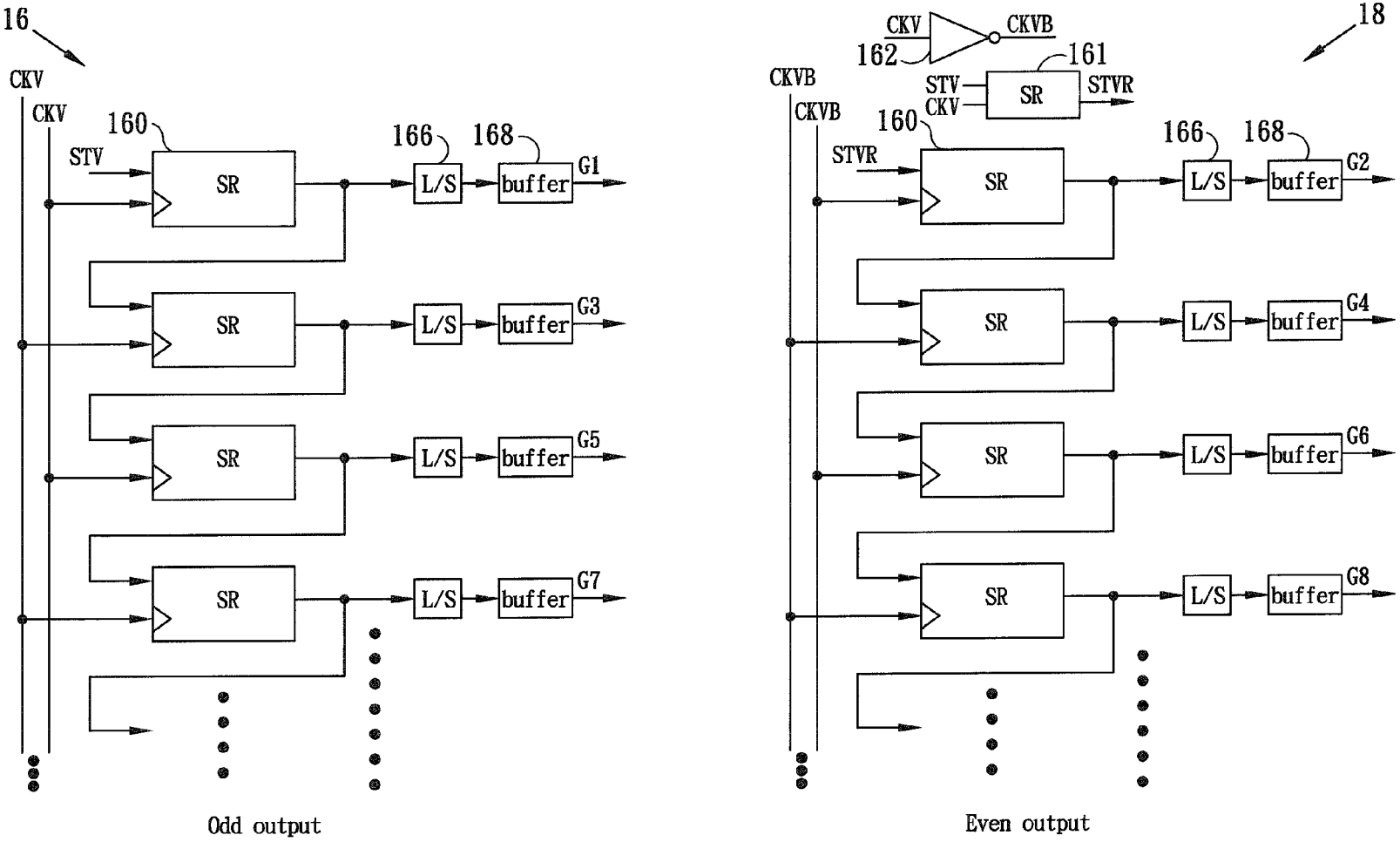
FIG. 2D illustrates a detailed circuit of the gate drivers in FIG. 2A according to the fourth embodiment of the present invention.
Figure 2E:
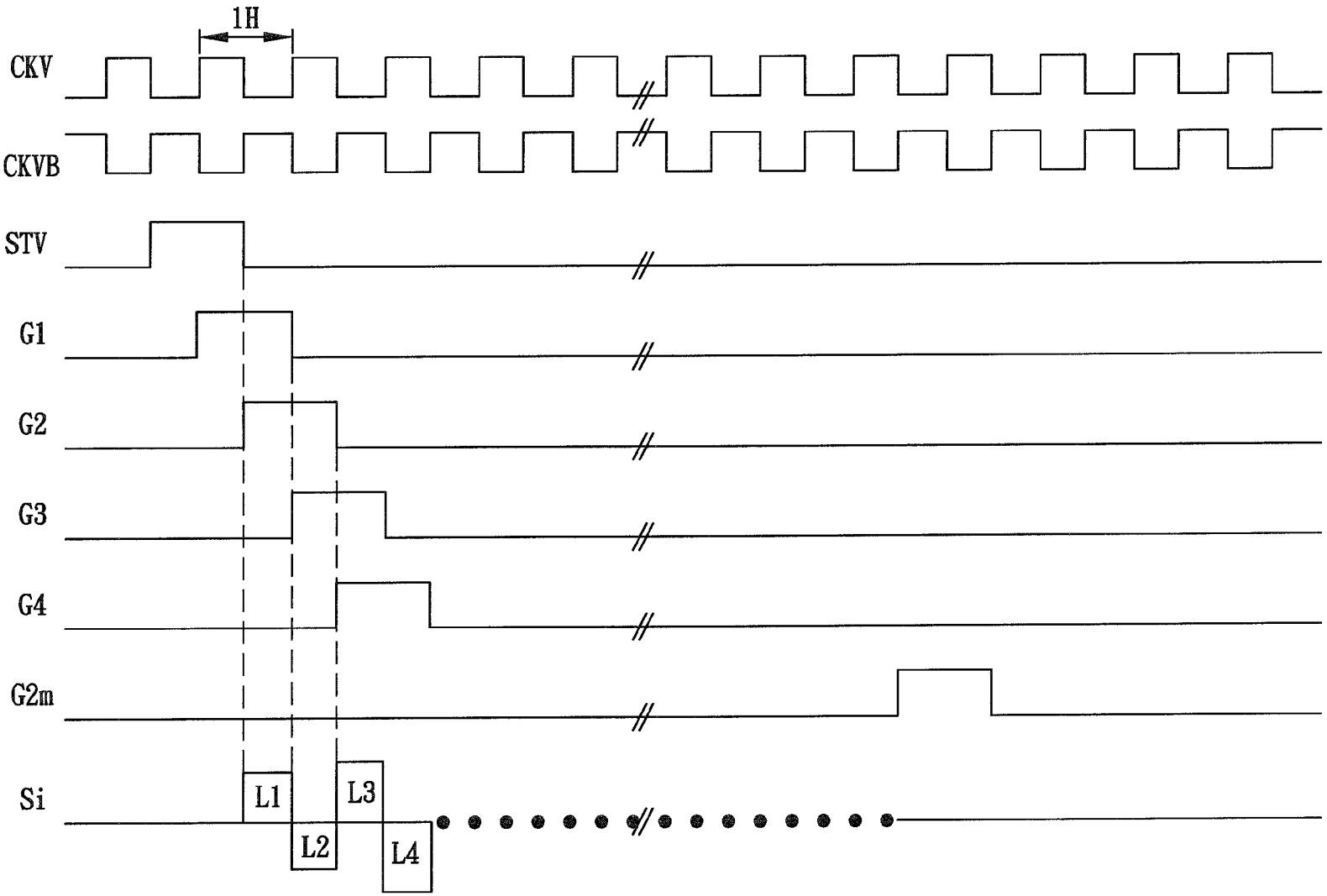
FIG. 2E shows a timing diagram illustrating the resultant gate driving waveforms associated with the gate drivers of FIG. 2D.

FIG. 2D illustrates detailed circuits of the gate driver A 16 and the gate driver B 18 in FIG. 2A according to the fourth embodiment of the present invention, and FIG. 2E shows a timing diagram illustrating the resultant gate driving waveforms associated with the gate drivers 16/18 of FIG. 2D.

In the embodiment, the gate drivers 16/18 have a structure similar to that in FIG. 2B, except that no logic circuits (for example, the AND gates 164 in FIG. 2B) are used. The comprising elements, such as the shift registers 160, the level shifters 166 and the output buffers 168 are coupled and operated in the same manner as those in FIG. 2B, except that the outputs of the shift registers 160 are directly coupled to the level shifters 166. Therefore, corresponding discussion is omitted here for brevity. As the logic circuits 164 (FIG. 2B) are not used in this embodiment to control the phase relationship between the resultant gate driving waveform and the horizontal synchronization signal CKV, the resultant gate driving signals G1-G2*m* accordingly have waveforms that are overlapping each other as shown in FIG. 2E.

Although specific embodiments have been illustrated and described, it will be appreciated by those skilled in the art that various modifications may be made without departing from the scope of the present invention, which is intended to be limited solely by the appended claims.

What is claimed is:

1. A double gate liquid crystal display (LCD), comprising:

a plurality of pixel electrodes arranged in a matrix form comprising rows and columns;

a plurality of thin film transistors (TFTs) corresponding to the plurality of pixel electrodes, respectively;

a gate driver comprising a gate driving signal generating circuit that generates a plurality of gate driving signals in response to horizontal synchronization signal;

wherein, with respect to a pair of neighboring columns, sources of the TFTs are connected together through a shared source line; and wherein, with respect to a row of said plurality of TFTs, odd-number TFTs are connected together through a gate line and even-number TFTs are connected together through another gate line; and wherein said gate driver comprises an odd gate driver for generating odd-number gate driving signals that drive the odd-number TFTs of the gate lines, and an even gate driver for generating even-number gate driving signals that drive the even-number TFTs of the gate lines, such that only a portion of each said gate line is driven at a time.

2. The double gate LCD of claim 1, wherein said gate driving signal generating circuit comprises:

a plurality of shift registers, wherein the first shift register is coupled to receive a vertical synchronization signal, output of each of the shift registers is coupled to input of the succeeding shift register, odd-number shift registers of said plurality of shift registers are operated under direct control of the horizontal synchronization signal, and even-number shift registers of said plurality of shift registers are operated under direct control of inverted horizontal synchronization signal.

3. The double gate LCD of claim 2, further comprising an inverter for inverting the horizontal synchronization signal into the inverted horizontal synchronization signal.

4. The double gate LCD of claim 2, further comprising a plurality of level shifters which are associatively coupled to receive the outputs of the shift registers respectively.

5. The double gate LCD of claim 4, further comprising a plurality of buffers which are associatively coupled to receive outputs of the level shifters respectively.

6. The double gate LCD of claim 2, further comprising a phase control circuit coupled to receive the outputs of the shift registers for determining phase relationship between the outputs of the shift registers and the horizontal synchronization signal.

7. The double gate LCD of claim 6, wherein said phase control circuit comprises:

a plurality of logic AND gates, each having a first input terminal for receiving the output of the associated shift register, and having a second input terminal;

wherein the second input terminals of the odd-number logic AND gates are coupled to receive the horizontal synchronization signal, and the even-number logic AND gates are coupled to receive the inverted horizontal synchronization signal.

8. The double gate LCD of claim 1, wherein said gate driving signal generating circuit comprises:

an odd circuit associated with the odd gate driver, said odd circuit comprising a plurality of odd shift registers, wherein the first odd shift register is coupled to receive a vertical synchronization signal, output of each of the odd shift registers is coupled to input of the succeeding odd shift register, the odd shift registers are operated under direct control of the horizontal synchronization signal; and an even circuit associated with the even gate driver, said even circuit comprising a plurality of even shift registers, wherein the first even shift register is coupled to receive a shifted vertical synchronization signal, output of each of the even shift registers is coupled to input of the succeeding even shift register, the even shift registers are operated under direct control of an inverted horizontal synchronization signal.

9. The double gate LCD of claim 8, further comprising an inverter for inverting the horizontal synchronization signal into the inverted horizontal synchronization signal.

10. The double gate LCD of claim 9, further comprising an additional shift register for shifting the vertical synchronization signal into the shifted vertical synchronization signal.

11. The double gate LCD of claim 8, further comprising a plurality of level shifters which are associatively coupled to receive the outputs of the odd or even shift registers respectively.

12. The double gate LCD of claim 11, further comprising a plurality of buffers which are associatively coupled to receive outputs of the odd or even level shifters respectively.

13. The double gate LCD of claim 8, further comprising a phase control circuit coupled to receive the outputs of the odd/even shift registers for determining phase relationship between the outputs of the odd/even shift registers and the horizontal synchronization signal or the inverted horizontal synchronization signal.

14. The double gate LCD of claim 13, wherein said phase control circuit comprises:

a plurality of logic AND gates, each having a first input terminal for receiving the output of the associated odd/even shift register, and having a second input terminal;

wherein the second input terminals of the logic AND gates are coupled to receive the horizontal synchronization signal in the odd circuit, and the second input terminals of the logic AND gates are coupled to receive the inverted horizontal synchronization signal in the even circuit.

15. The double gate LCD of claim 1, wherein said gate driving signal generating circuit generates the plurality of gate driving signals directly in response to the horizontal synchronization signal.

16. A gate driving method for a double gate liquid crystal display (LCD), the double gate LCD comprising a plurality of pixel electrodes arranged in a matrix form comprising rows and columns, and a plurality of thin film transistors (TFTs) corresponding to the plurality of pixel electrodes respectively, the gate driving method comprising:

generating a plurality of gate driving signals in a gate driver in response to horizontal synchronization signal;

wherein, with respect to a pair of neighboring columns, sources of the TFTs are connected together through a shared source line; and wherein, with respect to a row of said plurality of TFTs, odd-number TFTs are connected together through a gate line and even-number TFTs are connected together through another gate line; and wherein an odd gate driver generates odd-number gate driving signals that drive the odd-number TFTs of the gate lines, and an even gate driver generates even-number gate driving signals that drive the even-number TFTs of the gate lines, such that only a portion of each said gate line is driven at a time.

17. The gate driving method of claim 16, wherein the gate driving signals are non-overlapping each other.

18. The gate driving method of claim 17, wherein an odd-number gate driving signal of said plurality of gate driving signals is asserted active in first half cycle of a horizontal scan, and an even-number gate driving signal of said plurality of gate driving signals is asserted active in second half cycle of the horizontal scan.

19. The gate driving method of claim 18, further comprising providing valid data by a source driver within assertive active period of the odd/even-number gate driving signal.

20. The gate driving method of claim 16, wherein the gate driving signals are overlapping each other.

21. The gate driving method of claim 20, wherein an odd-number gate driving signal of said plurality of gate driving signals is asserted active beginning at activation of a horizontal scan, and an even-number gate driving signal of said plurality of gate driving signals is asserted active beginning at middle of the horizontal scan.

22. The gate driving method of claim 21, further comprising providing valid data by a source driver within second half of assertive active period of the odd/even-number gate driving signal.

23. The gate driving method of claim 16, further comprising adjusting voltage level of the gate driving signal.

24. The gate driving method of claim 23, further comprising buffering the voltage-level adjusted gate driving signal.

25. The gate driving method of claim 16, wherein said plurality of gate driving signals are generated directly in response to the horizontal synchronization signal.

* * * * *